US005974586A

United States Patent [19]

Reinoso

[11] Patent Number: 5,974,586

[45] Date of Patent: Nov. 2, 1999

[54] SUNLIGHT BLOCKING SLEEVES

[76] Inventor: Digna E. Reinoso, 10704 NW. 2nd Ave., Miami Shores, Fla. 33168

[21] Appl. No.: 09/124,730

[22] Filed: Jul. 30, 1998

[51] Int. Cl.[6] ..... A41D 27/10; A41D 27/28

[52] U.S. Cl. ..... 2/16; 2/59; 2/125; 2/126; 2/270; 2/309; 2/310; 2/311; 2/321; 2/912

[58] Field of Search ..... 2/16, 59, 93, 125, 2/126, 270, 912, 913, 915, 309, 310, 311, 321

[56] References Cited

U.S. PATENT DOCUMENTS

| | | | |
|---|---|---|---|
| 1,141,656 | 6/1915 | Rosenbaum et al. | 2/59 |
| 4,356,570 | 11/1982 | Vernon et al. | 2/59 |
| 5,023,953 | 6/1991 | Bettcher | 2/16 |
| 5,357,633 | 10/1994 | Rael | 2/16 |
| 5,575,014 | 11/1996 | Kane et al. | 2/16 |
| 5,628,062 | 5/1997 | Tseng | 2/16 |
| 5,638,546 | 6/1997 | Vita | 2/16 |

FOREIGN PATENT DOCUMENTS

| | | | |
|---|---|---|---|
| 355023 | 8/1931 | United Kingdom | 2/126 |

*Primary Examiner*—John J. Calvert
*Assistant Examiner*—Katherine Moran

[57] ABSTRACT

A new sunlight blocking sleeves for protecting the skin on the arms and shoulders of a wearer from sunlight. The inventive device includes a pair of sleeves with each sleeve having opposite wrist and shoulder openings and which is adapted for wearing on the arm and shoulder of a wearer the sleeve. An elongate flexible strap is coupled to the sleeve around the periphery of the shoulder. The flexible strap has a free end portion which is attachable to another portion of the flexible strap to hold the sleeve over the shoulder of a wearer.

1 Claim, 2 Drawing Sheets

SUNLIGHT BLOCKING SLEEVES

BACKGROUND OF THE INVENTION

1. Field of the Invention

The present invention relates to devices for protecting skin from sunlight and more particularly pertains to a new sunlight blocking sleeves for protecting the skin on the arms and shoulders of a wearer from sunlight.

2. Description of the Prior Art

The use of devices for protecting skin from sunlight is known in the prior art. More specifically, devices for protecting skin from sunlight heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for protecting skin from sunlight include U.S. Pat. No. 5,023,953; U.S. Pat. No. 4,475,252; U.S. Pat. No. 4,241,461; U.S. Pat. No. 4,068,316; U.S. Pat. No. 5,088,128; and U.S. Pat. No. 5,392,466.

While these devices fulfill their respective, particular objectives and requirements, the aforementioned patents do not disclose a new sunlight blocking sleeves. The inventive device includes a pair of sleeves with each sleeve having opposite wrist and shoulder openings and which is adapted for wearing on the arm and shoulder of a wearer. An elongated flexible strap is coupled to the sleeve around the periphery of the shoulder. The flexible strap has a free end portion which is attachable to another portion of the flexible strap to hold the sleeve over the shoulder of a wearer.

In these respects, the sunlight blocking sleeves according to the present invention substantially departs from the conventional concepts and designs of the prior art, and in so doing provides an apparatus primarily developed for the purpose of protecting the skin on the arms and shoulders of a wearer from sunlight.

SUMMARY OF THE INVENTION

In view of the foregoing disadvantages inherent in the known types of devices for protecting skin from sunlight now present in the prior art, the present invention provides a new sunlight blocking sleeves construction wherein the same can be utilized for protecting the skin on the arms and shoulders of a wearer from sunlight.

The general purpose of the present invention, which will be described subsequently in greater detail, is to provide a new sunlight blocking sleeves apparatus and method which has many of the advantages of the devices for protecting skin from sunlight mentioned heretofore and many novel features that result in a new sunlight blocking sleeves which is not anticipated, rendered obvious, suggested, or even implied by any of the prior art devices for protecting skin from sunlight, either alone or in any combination thereof.

To attain this, the present invention generally comprises a pair of sleeves with each sleeve having opposite wrist and shoulder openings and which is adapted for wearing on the arm and shoulder of a wearer. An elongate flexible strap is coupled to the sleeve around the periphery of the shoulder. The flexible strap has a free end portion which is attachable to another portion of the flexible strap to hold the sleeve over the shoulder of a wearer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sunlight blocking sleeves apparatus and method which has many of the advantages of the devices for protecting skin from sunlight mentioned heretofore and many novel features that result in a new sunlight blocking sleeves which is not anticipated, rendered obvious, suggested, or even implied by any of the prior art devices for protecting skin from sunlight, either alone or in any combination thereof.

It is another object of the present invention to provide a new sunlight blocking sleeves which may be easily and efficiently manufactured and marketed.

It is a further object of the present invention to provide a new sunlight blocking sleeves which is of a durable and reliable construction.

An even further object of the present invention is to provide a new sunlight blocking sleeves which is susceptible of a low cost of manufacture with regard to both materials and labor, and which accordingly is then susceptible of low prices of sale to the consuming public, thereby making such sunlight blocking sleeves economically available to the buying public.

Still yet another object of the present invention is to provide a new sunlight blocking sleeves which provides in the apparatuses and methods of the prior art some of the advantages thereof, while simultaneously overcoming some of the disadvantages normally associated therewith.

Still another object of the present invention is to provide a new sunlight blocking sleeves for protecting the skin on the arms and shoulders of a wearer from sunlight.

Yet another object of the present invention is to provide a new sunlight blocking sleeves which includes a pair of sleeves with each sleeve having opposite wrist and shoulder openings and which is adapted for wearing on the arm and shoulder of a wearer. An elongated flexible strap is coupled to the sleeve around the periphery of the shoulder. The flexible strap has a free end portion which is attachable to another portion of the flexible strap to hold the sleeve over the shoulder of a wearer.

Still yet another object of the present invention is to provide a new sunlight blocking sleeves that are directly attachable to the shoulders of a wearer and which do not require attachment to a shirt (or other article of clothing) worn by the wearer.

Even still another object of the present invention is to provide a new sunlight blocking sleeves that helps prevent damage to skin from exposure to sunlight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
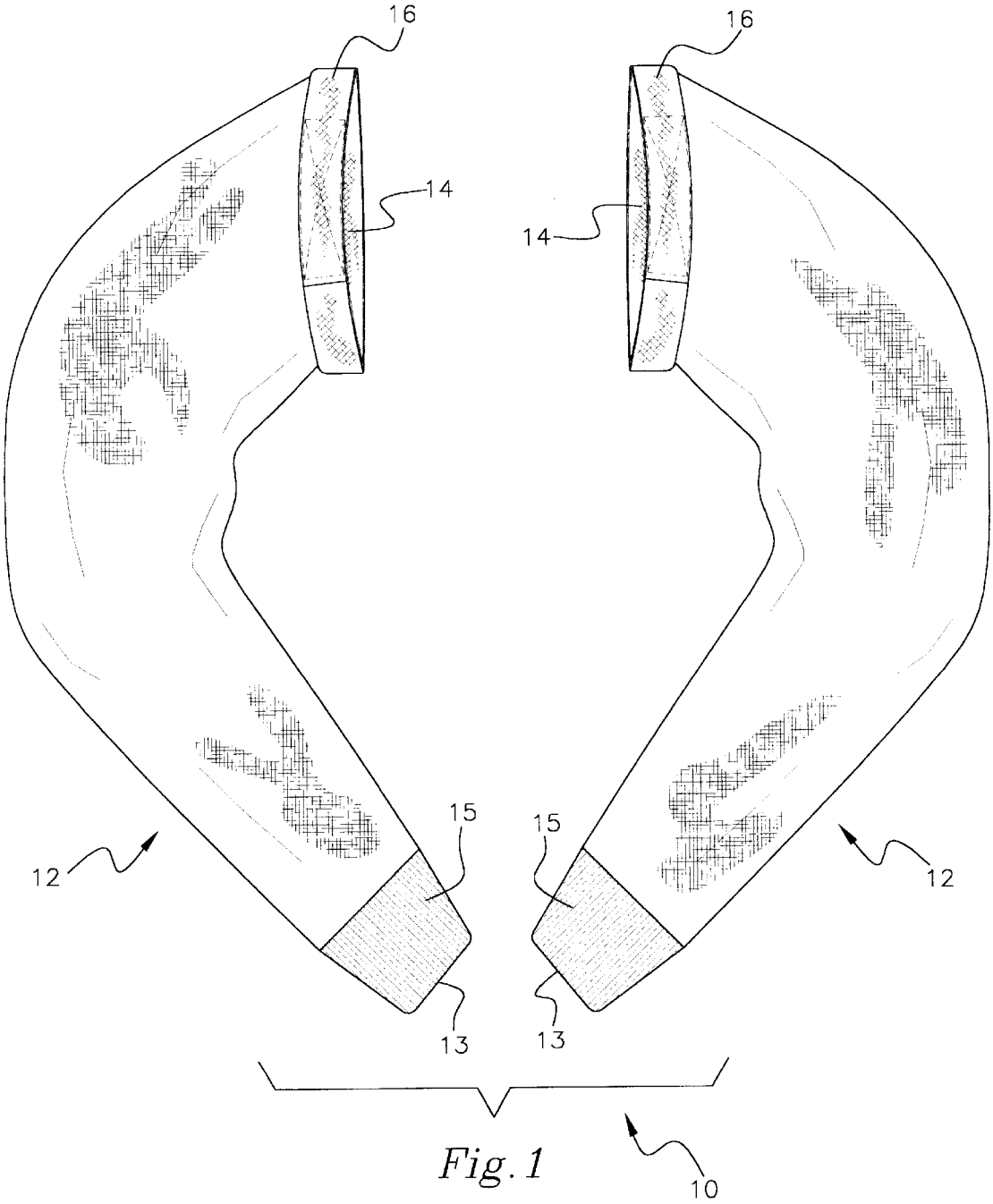
FIG. 1 is a schematic side view of a new sunlight blocking sleeves according to the present invention.
Figure 2:
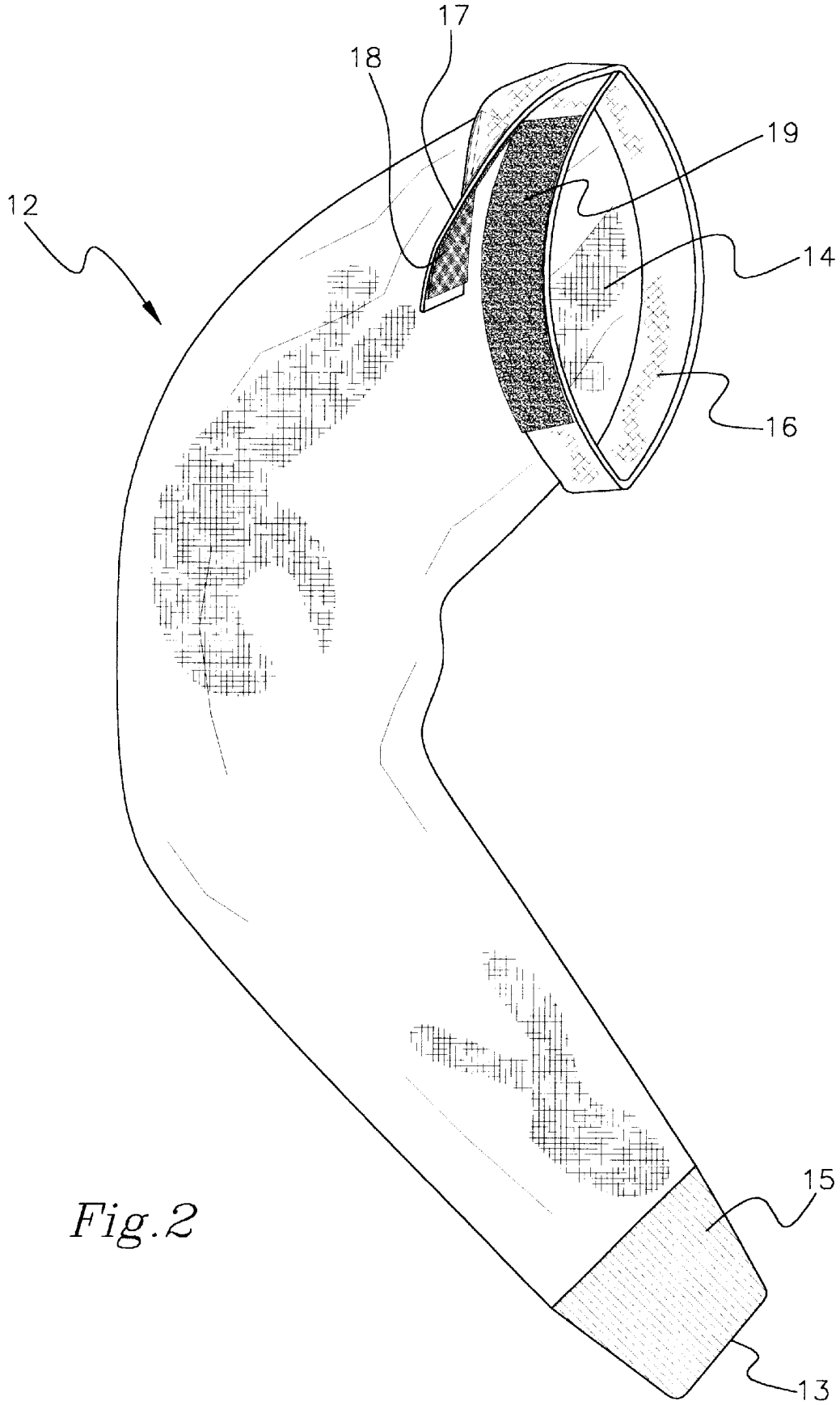
FIG. 2 is a schematic side view of a sleeve of the present invention with the free end portion of the flexible strap detached.

With reference now to the drawings, and in particular to FIGS. 1 through 2 thereof, a new sunlight blocking sleeves embodying the principles and concepts of the present invention and generally designated by the reference numeral 10 will be described.

In use, the sunlight protecting sleeves each serve as a protective garment for protecting an arm and shoulder of a wearer from exposure to sunlight. As best illustrated in FIGS. 1 through 2, each of the sunlight blocking sleeves 10 generally comprises a sleeve 12 having opposite wrist and shoulder openings 13,14 and which is adapted for wearing on the arm and shoulder of a wearer the sleeve 12. An elongated flexible strap 16 is coupled to the sleeve 12 around the periphery of the shoulder. The flexible strap 16 has a free end portion 17 which is attachable to another portion of the flexible strap 16 to hold the sleeve 12 over the shoulder of a wearer.

In closer detail, each sleeve 12 is adapted for wearing on the arm and shoulder of a wearer. The sleeve 12 has a opposite wrist and shoulder openings 13,14. The sleeve 12 should be of sufficient length to extend from the wrist of the wearer to over the shoulder of a wearer so that when worn, the wrist opening 13 end positioned around the wrist of the wearer while the shoulder opening 14 end positioned over the shoulder of a wearer. Preferably, the sleeve 12 comprises a flexible material. Ideally, the sleeve 12 comprises a material has a fiber content of less than about 80% cotton fibers and less than about 20% polyester fibers so that a wearer has a breathable fabric to keep the wearer cool while still blocking sunlight therethrough to the wearer from exposure. Optionally, the sleeve 12 comprises a fire resistant material that resists combustion when exposed to a fire. Also ideally, the sleeve 12 has an elastic portion 15 adjacent the wrist opening 13 of the sleeve 12. The elastic portion 15 is designed for holding the sleeve 12 around the wrist of a wearer.

The elongated flexible strap 16 is coupled to the sleeve 12 around the periphery of the shoulder opening. The flexible strap 16 has a free end portion 17 which is attachable to another portion of the flexible strap 16 for holding the sleeve 12 over the shoulder of a wearer. Preferably a fastener, ideally, a hook and loop fastener 18,19, detachably attaches the free end portion 17 of the flexible strap 16 to the other portion of the flexible strap 16. In use, the strap is used to tighten above the shoulder of a wearer to hold the sleeve 12 to the wearer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective garment for protecting an arm and shoulder of a wearer from exposure to sunlight, said protective garment comprising:

a sleeve being adapted for wearing on the arm and shoulder of a wearer, said sleeve having opposite wrist and shoulder openings;

wherein said sleeve comprises a flexible material, wherein said sleeve comprises a material having a fiber content of less than about 80% cotton fibers and less than about 20% polyester fibers for affording a breathable fabric to keep the wearer cool while blocking sunlight therethrough to the wearer, wherein said sleeve comprises a fire resistant material that resists combustion when exposed to a fire;

said sleeve having an elastic portion adjacent said wrist opening of said sleeve, said elastic portion being for holding the sleeve around a wrist of the wearer;

an elongate flexible strap with a mounted portion having a peripheral edge being coupled to a peripheral edge of said sleeve about the periphery of said shoulder opening with a first end and a second end, said flexible strap further having a free end portion having an end coupled to one of the ends of said mounted portion of said flexible strap, said free end portion of said flexible strap being attachable to said mounted portion of said flexible strap for holding said sleeve over the shoulder of a wearer; and wherein a fastener detachably attaches said free end portion of said flexible strap to said mounted portion of said flexible strap, wherein said fastener comprises a hook and loop fastener with one fastener portion coupled to said free end portion of said flexible strap and another fastener portion coupled to said mounted portion of said flexible strap.

* * * * *